US005123640A

United States Patent [19]

Rebeaud

[11] Patent Number: 5,123,640

[45] Date of Patent: Jun. 23, 1992

[54] FEEDER TABLE UTILIZING SIDE AND FRONT EDGE ALIGNERS

[75] Inventor: Jean-Claude Rebeaud, Le Mont, Switzerland

[73] Assignee: Bobst SA, Switzerland

[21] Appl. No.: 689,551

[22] Filed: Apr. 23, 1991

[30] Foreign Application Priority Data

Apr. 25, 1990 [CH] Switzerland ..... 01406/90

[51] Int. Cl.[5] ..... B65H 9/00

[52] U.S. Cl. ..... 271/236; 271/137; 271/243; 271/245; 271/251; 271/254; 271/253; 271/273

[58] Field of Search ..... 271/250, 251, 252, 253, 271/273, 274, 254, 137, 236, 234, 243, 245, 246, 167

[56] References Cited

U.S. PATENT DOCUMENTS

| | | | |
|---|---|---|---|
| 2,819,078 | 1/1958 | Durand | 271/251 X |
| 3,107,089 | 10/1963 | Lockey | 271/251 |
| 3,175,824 | 3/1965 | Albosta | 271/251 |
| 3,915,449 | 10/1975 | Johnson et al. | 271/251 |
| 4,019,025 | 4/1977 | Taniguchi et al. | 271/273 X |
| 4,505,471 | 3/1985 | Stockburger et al. | 271/251 |
| 4,607,835 | 8/1986 | Wilson et al. | 271/251 X |
| 4,644,834 | 2/1987 | Hanni et al. | 271/251 X |
| 4,655,446 | 4/1987 | Heindke et al. | 271/273 X |
| 4,676,498 | 6/1987 | Kanemitsu et al. | 271/251 |
| 4,875,670 | 10/1989 | Peterson et al. | 271/273 X |
| 4,919,318 | 4/1990 | Wong | 271/250 X |

FOREIGN PATENT DOCUMENTS

| | | | |
|---|---|---|---|
| 3500986 | 7/1986 | Fed. Rep. of Germany | 271/251 |
| 112352 | 5/1988 | Japan | 271/251 |

*Primary Examiner*—H. Grant Skaggs
*Assistant Examiner*—Boris Milef
*Attorney, Agent, or Firm*—Hill, Van Santen, Steadman & Simpson

[57] ABSTRACT

A device for correcting lateral alignment of a workpiece removed from a pile of workpiece prior to being fed into a processing machine. The device includes at least two pairs of rollers spaced along the direction of movement of the sheet, with each pair of rollers including a driven lower roller and a driven upper roller, with the upper roller having its axis forming a slight angle with the axis of the lower roller to provide a lateral force to move the workpiece against a lateral guide. The device can be used in the second arrangement providing front stops for aligning the front or leading edge of the workpiece after the lateral position alignment has been accomplished.

6 Claims, 5 Drawing Sheets

FEEDER TABLE UTILIZING SIDE AND FRONT EDGE ALIGNERS

BACKGROUND OF THE INVENTION

The present invention is directed to a device for aligning plates or sheet-shaped workpieces as they are used in an infeed station of a package producing machine, which device includes a feeding table provided with a horizontal passage allowing a sheet or workpiece to travel through, one-by-one, and having a length, which, in the travelling direction, covers the distance at least equal to the length of the maximum size of the sheet being process and has two pairs of rollers, with each pair having a lower driven roller and an upper roller, the lower driven roller being positioned beneath the passage and serving as a support for the sheet and the upper roller being situated on top of the passage and being mounted for movement between a rest position without exerting pressure on or contact with the sheet and a second position in which it will urge the sheet toward the lower roller, the axis of rotation of the lower roller being substantially perpendicular to a direction of travel of the sheet, while the upper roller can be moved to a position forming a slight angle with the axis of the lower roller to cause the sheet to be urged laterally against a guiding or aligning edge of the feeder table.

In machines for printing workpieces formed by sheets of pasteboard or corrugated cardboard and in machines for cutting such workpieces, the workpieces are generally loaded as successive piles into an infeed station. In many cases, the piles are neither exactly straight vertically nor properly centered on the machine axis. For this reason, after the successive separation of the workpiece, either from the top or the bottom of the pile, the various workpieces are fed individually into a device for a lateral and frontwise alignment in order to have them accurately positioned with regard to either gripper bars, which are fitted on a pair of endless chains and are designed to carry the workpiece individually through the subsequent cutting and waste stripping stations of the die-cutting machine or to infeed rollers of, for instance, a flexographic printing station.

For this purpose, such machines generally include an infeed station with a feeder table provided with a passage, which has a length in the sheet travelling direction to be at least equal to the maximum size of the sheet to be processed. After the workpiece arrives on the feeding table, the workpiece is stopped by aligning front lays or stops. Thereupon, an upper and lower roller acting pairwise will nip the sheet edge and, owing to their rotary motion, pull it sidewise against a lateral guiding surface or ruler. The axis of the two rollers is arranged essentially perpendicular to the sheet travelling direction. When rotated, the lower roller is held in a fixed horizontal plane, whereas the upper roller acts as a free wheel and may take a first position, in which it is not in pressure contact with a sheet, and a second position, in which it presses the sheets against the lower roller.

A major shortcoming of such a device for lateral and frontwise alignment is that it imposes a full standstill or stopping of each sheet. Such a standstill, which is followed by further conveyance, not only requires relatively complicated control means, but also is hardly compatible with the present, unceasingly increasing production speeds, since a standstill necessitates augments of the duration of the aligning operation.

Moreover, it is ensued from prior art that continuous aligning of travelling sheets can be achieved by means of a pair of rollers, of which the lower one is driven in the travelling direction, whereas the upper one acting as a free wheel is arranged slightly obliquely with regard to the travelling direction. However, the upper roller is subjected to a premature wear, since not only is it vulcanized and not driven, but also has a tendency to leave a furrow-like compression on a sheet during its first contact with the roller when at a standstill. In such a case, the sheets are generally pushed from behind by auxiliary means.

In addition, the aligning devices, known up to now, have the drawback of requiring two reference lines on the sheet, one on the rear edge enabling the gripper bars to seize it in the cutting, creasing and embossing station, and the other on the front edge for rollers of a printer, which way of handling may necessitate a 180° inversion or turning over of the sheet when it passes from the printing device to the cutting unit.

SUMMARY OF THE INVENTION

An object of the present invention is to eliminate the drawbacks mentioned above. These objects are obtained by means of an aligning device for a workpiece, which is either a sheet or a plate, which is used in an infeed station for either a process machine which cuts, embosses or prints the workpiece during the production of a package. The device includes a feed table with a horizontal passage allowing the workpiece to travel through one-by-one, with the passage having a length in the travelling direction which covers a distance at least equal to the length of the maximum workpiece being processed, at least two pairs of rollers, each pair consisting of an upper roller and a lower roller, the lower roller of each pair being situated underneath the passage and serving as a support for the workpiece, while the upper roller is located above the passage and is movable between a first retracted or rest position without applying pressure on the sheet to a second or engaging position, in which it urges the sheet or workpiece toward the lower roller. Each of the lower rollers is driven so that a peripheral motion is essentially parallel to the travelling direction of the sheet for a continuous conveyance during the lateral aligning operation. The pairs of rollers are arranged along the length of the feeding table and the upper rollers are driven with a peripheral motion identical to one of the lower rollers so that a sheet will be conveyed in the travelling direction. Each of the upper rollers has an individual arrangement with regard to the other roller so that, while in a first horizontal position, the peripheral motion is slightly oblique and forms an angle in a range of 5° and 10° with the travelling direction to cause a lateral shifting of a sheet against a lateral guide edge, means for moving upper rollers from the parallel arrangement with regard to the travelling direction to said oblique arrangement against the resistance opposed by the travelling sheet and control means for individually shifting each of the upper rollers from the engaging position to the rest position as the front edge of the sheet approaches the corresponding roller pair and from the rest position to the engaging position as soon as the front edge has entered between said roller pair.

Other advantages and features of the invention will be readily apparent from the following description of the preferred embodiments, the drawings and claims.

DESCRIPTION OF THE PREFERRED EMBODIMENTS

Figure 1:
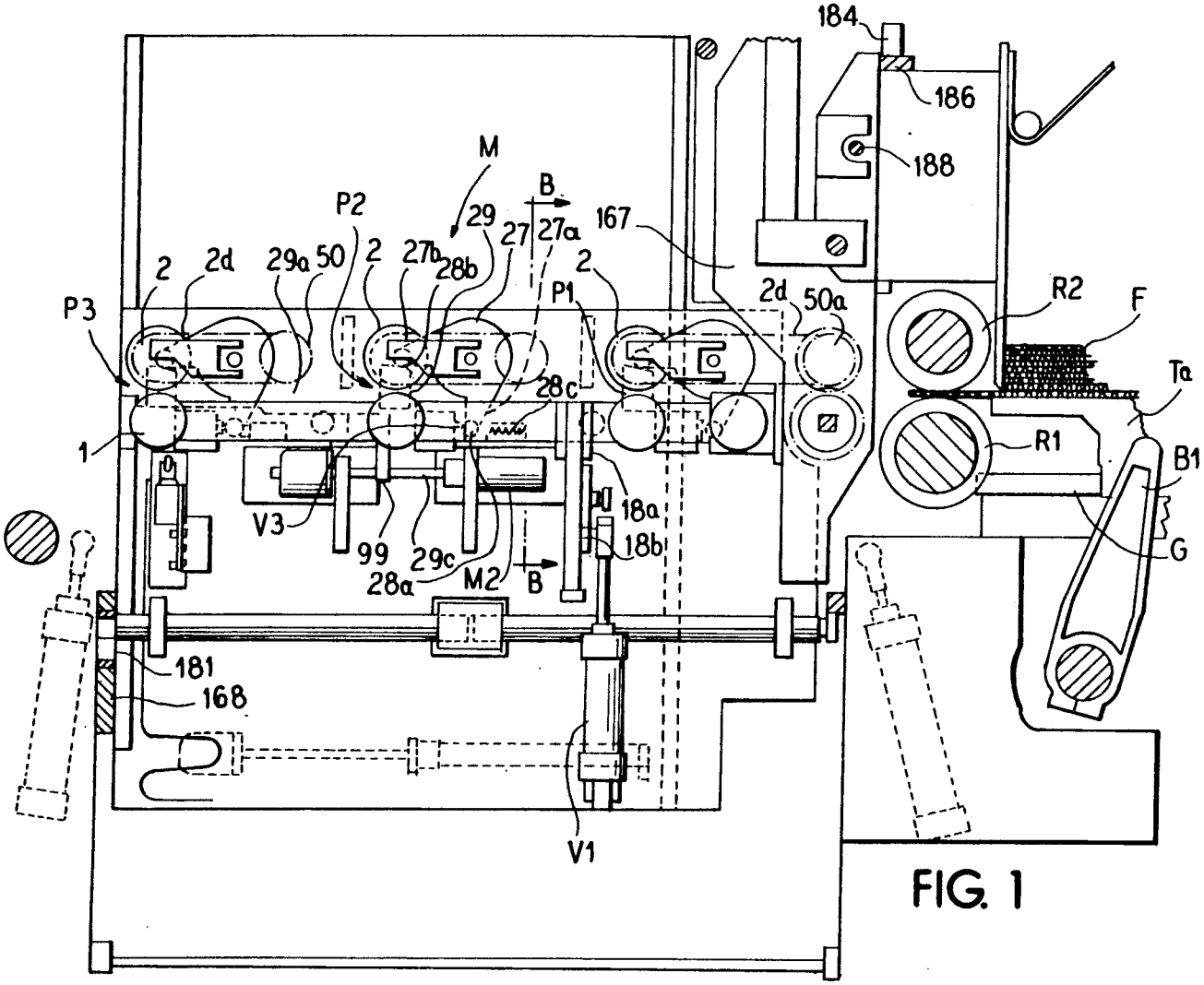
FIG. 1 is a side view with portions broken away for purposes of illustration of a lateral aligning device in accordance with the present invention.

The principles of the present invention are particularly useful when incorporated in a feed table, generally indicated at M. As illustrated in FIG. 1, a batch of sheets or workpieces F, of which the lowermost is seized by a suction table Ta and is to be transferred between two large rollers R1 and R2 as the table Ta is shifted along a guide G by a lever B1. As soon as the front edge of the sheet is shifted between the rollers R1 and R2, the suction in the suction table is released so that the sheet or workpiece F will be pulled away from the batch bottom and carried into a lengthwise passage of the feeder table M.

In the feeder table, the space or width of the passage is determined by six pairs P1–P3, with each pair consisting of a lower roller 1 and an upper roller 2. Every lower roller 1 is situated underneath the sheet passage and every upper roller on top of the sheet passage. The six pairs P1–P3 are arranged in two assemblies, of which one is situated on the operator's lateral side and the other is situated on a side opposite the operator. The three pairs P1–P3 of each assembly are arranged over the whole length of the table, which is to say that when viewed in the travelling direction of the sheet or workpiece F, a first pair P1 is situated on the entrance end of the device M, the second pair P2 is in the middle, and the third pair is near the exit or discharge end. The length of the feeder table M is at least equal to one of the maximum size of the sheets to be processed.

Figure 2:
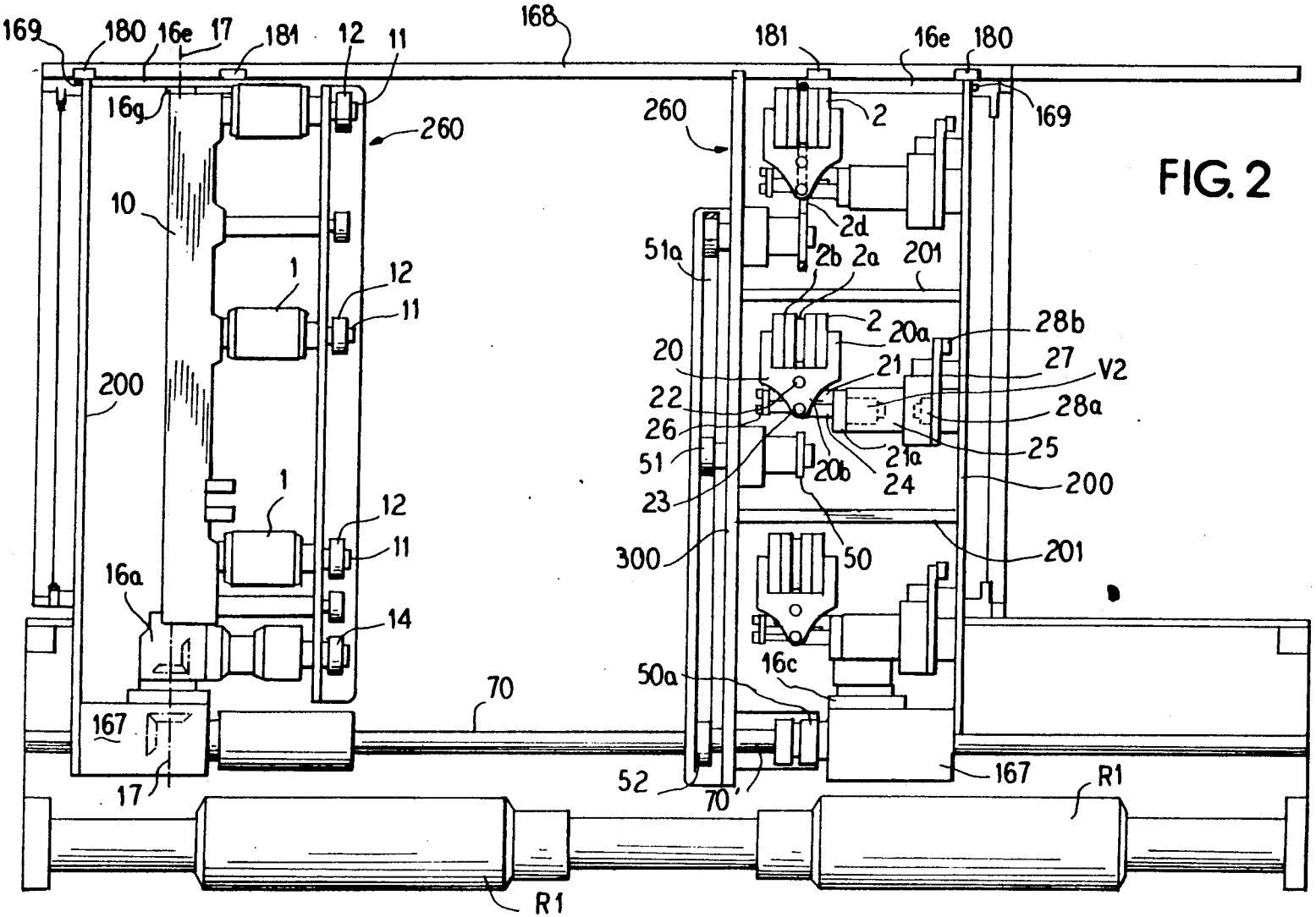
FIG. 2 is a top plan view of the device of FIG. 1 with portions broken away for purposes of illustration.

As illustrated in FIG. 2, the left-hand side shows the upper rollers being removed so that only the lower rollers of each pair is illustrated, whereas, on the right-hand side, the upper rollers and their portions are illustrated.

As illustrated in FIG. 2, two sub-frames 260 consisting of a plate 200 connected by cross members 201 to a plate 300 along with an end member **16*e* and a vertical piece 167, are mounted in the main frame of the device M, which includes a track 168 and 186 (FIG. 1**).

Each of the lower, smooth steel rollers 1 are constructed to support and carry the sheet or workpiece F. All the lower rollers 1 are mounted for rotation on a lateral bar 10. As illustrated, each of the lower rollers 1 has a shaft 11 which, on a free end, is provided with a keyed toothed pulley or roller 12 which cooperate jointly with a toothed belt 13 (see FIG. 3), which is driven by a toothed pulley 14, which is mounted at an upstream end of the lateral bar 10. To enable the removal from the table of a sheet F considered as defective, the lower rollers 1 can be retracted so as to enable the sheet to be dropped. For this purpose, the downstream or exit end of the bar 10 is mounted on the vertical plate **16*e* by means of a supporting stud 16*g* so that it is able to rotate freely around a horizontal axis 17. The upstream or inlet end of the bar 10 is fitted on an intermediary piece 16*a* to rotate around the axis 17 relative to a large vertical piece 167. As illustrated, a first pair of tapered wheels or beveled gears are arranged inside the intermediate piece 16*a*, as well as a second pair which are arranged in the vertical piece 167 to enable the pulley 14 to be rotated and to drive via the belt 13 all of the lower rollers 1. In addition, this arrangement allows the rollers and the bar 10 to pivot or rotate on the axis 17 when a sheet or workpiece is to be scrapped. To provide the motive force for rotating the pulley 14 through the gear arrangement, one of the gears in the structure 167 is engaged with a transmission bar 70, which has an end connected to a drive source, which is not illustrated. The transmission bar 70** has a square cross section so that the sub-frame can be shifted laterally to compensate for different sized widths for the workpiece.

Figure 3:
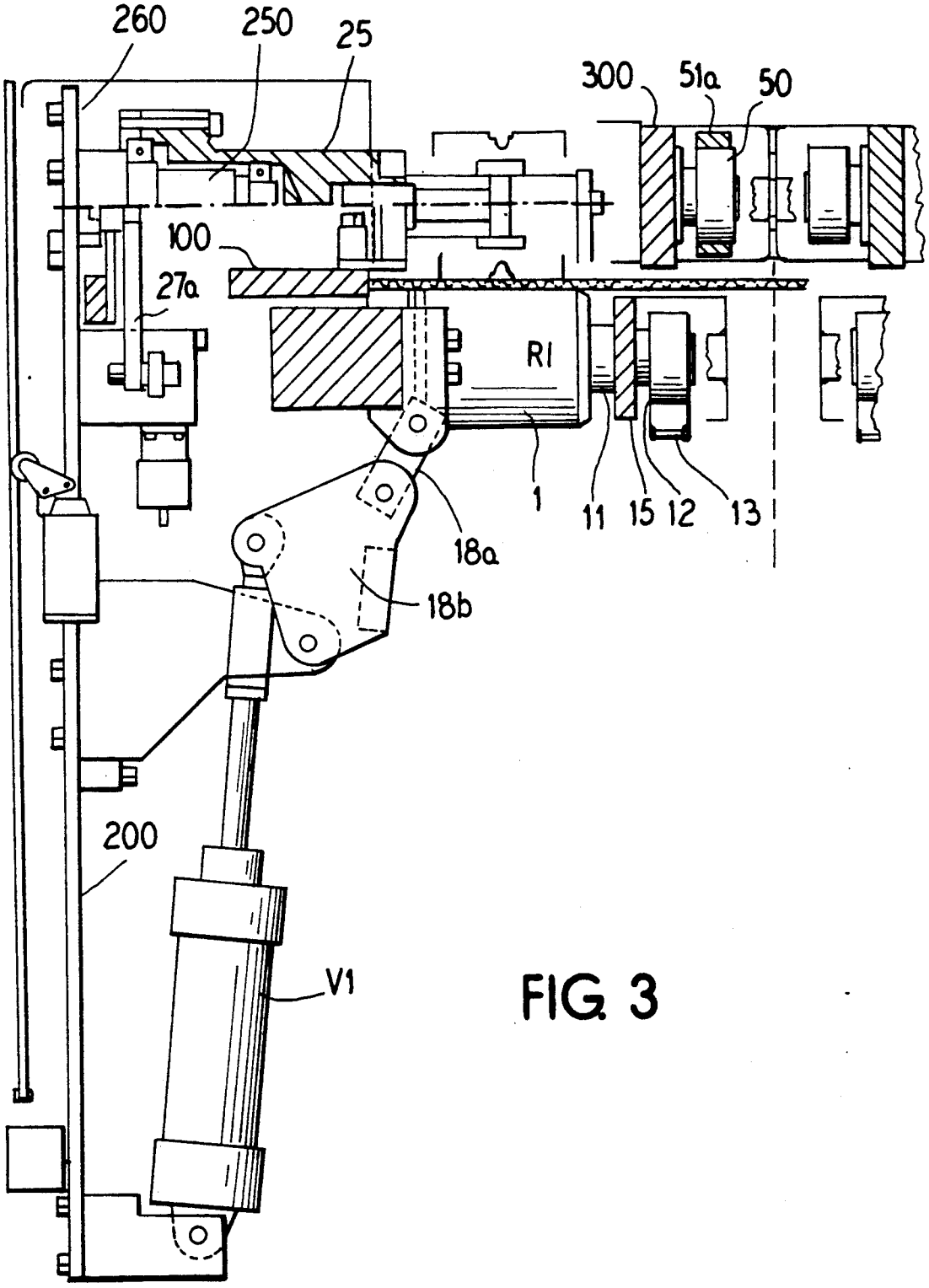
FIG. 3 is a cross sectional view taken approximately along the lines B—B of FIG. 1.

As mentioned above, the lateral bar 10, along with each of the rollers 1, can be rotated on the axis 17. This is accomplished, as best illustrated in FIG. 3, by a pneumatic piston or jack V1, which has one end secured or mounted on the plate 200 and a piston rod connected through connecting linkage **18*a* and 18*b* to the lateral bar 10**.

The principal function of the upper rollers 2 is to enhance the reliability of the conveyance of the sheet or workpiece F in the travelling direction by pressing it toward the lower roller 1 and a secondary function which is to insure a sidewise alignment, i.e., shifting the workpiece travelling toward one of two lateral alignment rulers 100 (see FIG. 3), which is provided on either side of the table M. In order to enable every upper roller 2 to assume the double-function, every one of them is to occupy either a first or second vertical position. In the first vertical position, it enables a sheet to easily enter between the upper and lower rollers of each pair. In the second vertical position, it will urge the sheet toward the lower roller in order to move it in the travelling direction. To accomplish the second function, each of the second rollers must rotate with a peripheral speed equal to the peripheral speed of the lower roller of its pair and the direction of this may be shifted between a first lateral position, which is parallel to the direction of rotation for the lower roller, for example the axes of the two rollers of the pair are parallel, to a second lateral position, wherein the axis of the upper roller 2 forms a small angle in a range of 5° to 10° relative to the axis of the lower roller to cause a lateral shifting of the sheet or workpiece F.

To accomplish these goals, every upper roller 2 is mounted on a first support 20 (see FIG. 5), which has four flanges which are arranged in pairs with two of the flanges forming a strap portion **20*a* and the other two, which extend in the opposite direction, forming a strap portion 20*b*. The upper roller 2 is mounted for rotation on an axis essentially perpendicular to the travelling direction by being mounted between the two flanges forming the strap portion 20*a*. An intermediate or auxiliary support 21 has a free end extending into the second strap portion 20*b*. The first support 20 is mounted for free pivoting on the auxiliary support 21 by a vertical axle or pin 22, which is situated within the central part between the straps 20*a* and 20*b***. The auxiliary support 21 is provided with a hollow cylindrical part 21*a*, which is mounted and centered on an end of a cylindrical support 25, which is mounted on bearings on a member 250 (see FIG. 3), which is mounted on the lateral plate 200 of the sub-frame 260. Thus, the support 25, along with the auxiliary support 21, can rotate on an axis, which is substantially a horizontal axis that extends substantially perpendicular to the direction of movement of the workpiece through the machine.

Figure 5:
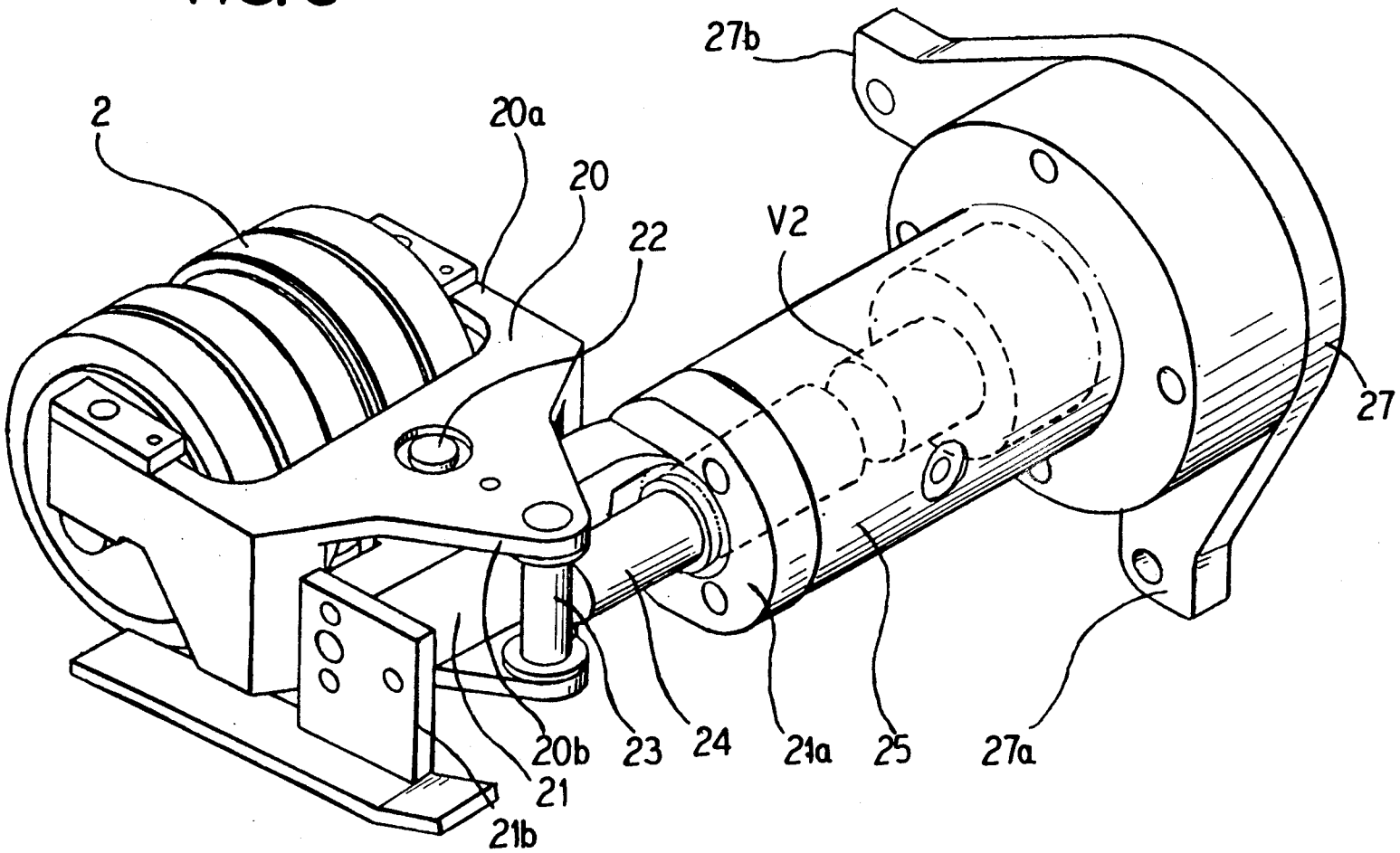
FIG. 5 is a perspective view of a portion of the top aligning roller and its pivotable support.

In addition to the above, the two flanges forming the second strap 20*b* are interconnected by a rod or pin 23, as illustrated in FIG. 5. This rod is acted on by an outer end of a ram 24 of a pneumatic jack V2, which is arranged inside of and on the axis of the cylindrical support 25. The purpose of the jack V2 consists in exerting a certain force on the rod 23 so as to have the support 20 pivot around the axle 22 and, hence, cause the upper roller to be put into the slightly oblique position with regard to the travelling direction against the force exerted by the travelling sheet or workpiece. By actuating or control of the jack V2, the roller can take up the normal parallel position with regard to the travelling direction as soon as the force exerted by the sheet F exceeds a certain rate, which is the case when the sheet F touches the lateral aligning rule 100 with the travelling direction including no lower crosswise component. The auxiliary support 21, on an end 21*b* opposite the hollow cylindrical portion 21*a*, receives a screw 26 (see FIG. 2), which forms an adjustable stop for the rod 23 in order to limit the pivoting range of the support 20 in the direction toward the oblique position.

In order to rotate or shift the roller 2 between its two vertical positions, control means are provided and include a lever 27 which is connected to the opposite end of the cylindrical support 25 and has an arm 27*a* extending downward vertically and a horizontal arm 27*b*, each of which is provided with rollers 28*a* for the arm 27*a*, and 28*b* for the arm 27*b*. The roller 28*b* (see FIG. 1) of the horizontal arm 27*b* rides on a slanted surface of an arresting piece 29 mounted on a lateral shiftable bar 29*a*, which carries the arresting piece 29 for each of the pairs P1, P2, P3. Due to a slanting surface of the arresting piece 29, the lengthwise shifting of the bar 29*a* allows a setting of the operational height of the upper roller 2 in the position in which they are to press the sheet F against the lower roller 1. Shifting of the bar 29*a* is achieved by means of a motor M2, which drives a spindle 29*c*, which threadably receives a threaded bore in a projection 99, which is connected to the lower side of the bar 29*a*.

Figure 4:
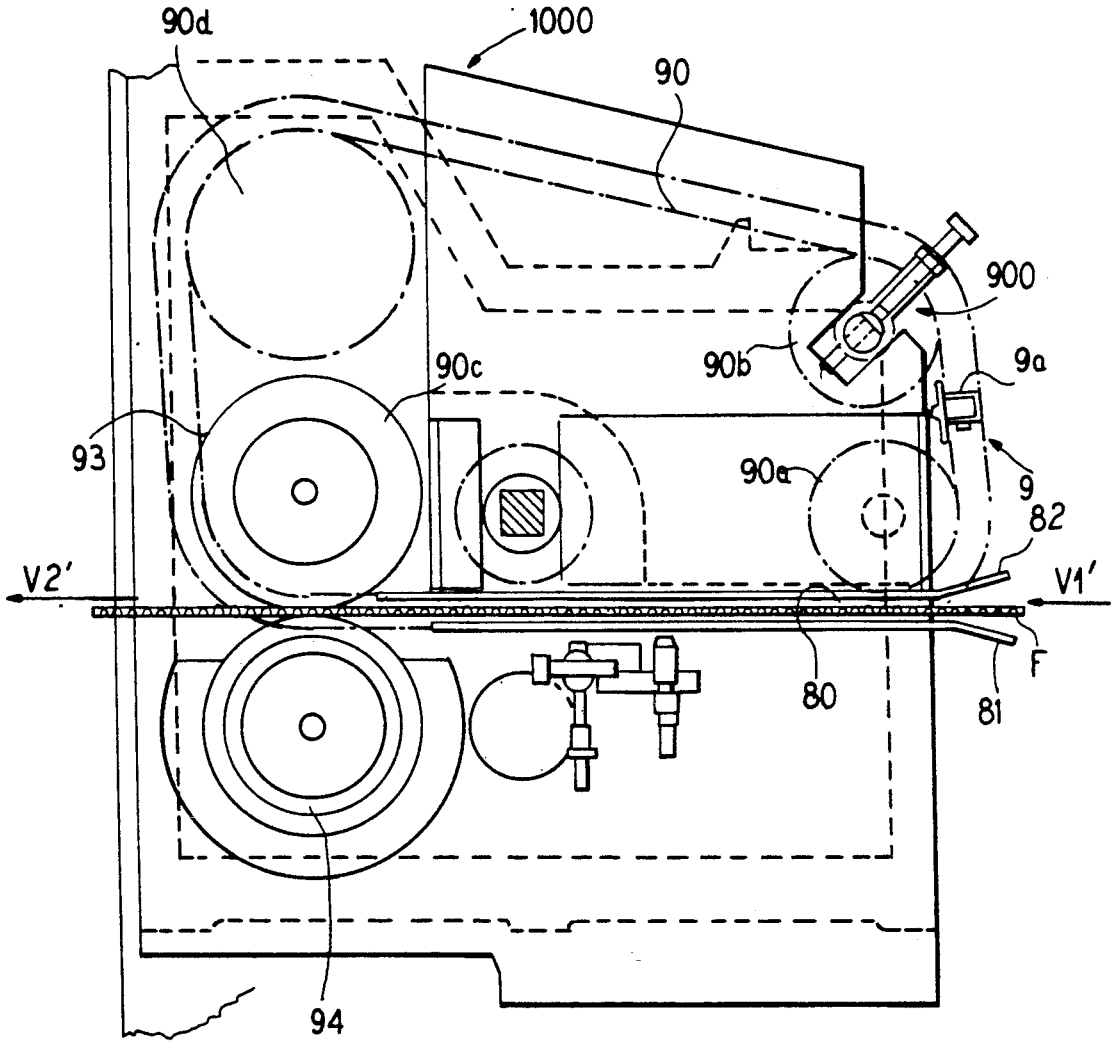
FIG. 4 is a side view of a front aligning device in accordance with the present invention.

The other roller 28*a* is engaged by a ram or piston rod of a pneumatic jack V3, which will force the lever to pivot in a direction to keep the roller 28*b* in contact with the arresting piece 29. The jack V3 is successively put into action as soon as a leading edge of a sheet or workpiece has extended in between the two rollers 1 and 2 of the same pair. The jack is deactivated or put out of operation either when the trailing edge has left from extending between the two rollers 1 and 2 of the pair so as to insure easy penetration of the leading edge of the following sheet, or, when the sheet has been picked up by a gripping bar of the next following device or the rollers 93 and 94 of the device 1000, which is shown in FIG. 4. A spring 28*c* holds the roller 28*a* against the end of the piston rod of the jack V3 so that, as illustrated in FIG. 1, when the jack V3 is deactivated, the arms will rotate in a clockwise direction to lift the rollers 2 to the upper vertical or retracted position. The control means includes the jack V3, the motor M2 and all of the linkage between the lever 29 and the jack V3 and motor M2.

The vulcanized periphery of the upper rollers is provided with small grooves 2*b* (see FIG. 5), which insure such features as elasticity, cooling and wear control. Each of the upper rollers also has a radial groove 2*a*, which is destined to act jointly with a round endless drive belt 2*d* (FIGS. 1 and 2) connected to a corresponding auxiliary pulley 50 situated adjacent thereto. The arrangement of the upper roller 2 and its auxiliary pulley 50 is such as to enable the belt to insure its driving action without being interfered by the slight oblique positioning of the roller 2. Each of the auxiliary pulleys 50 is keyed onto a first end of a shaft capable of rotating freely on a lateral plate 300 (see FIG. 2) of the feeder table M. The other end of each of these shafts has a toothed pulley 51 keyed thereto. To insure joint rotation of all of the pulleys 50, the pulleys 51 are driven by a common endless belt 51, which extends to a drive pulley 52 rotated on a transmission shaft 70'. It should be noted that the upper roller 2 of the pair adjacent the inlet end is not driven by a pulley 50, as are the other upper rollers, but is driven by a pulley 50*a*, which is mounted on the transmission shaft 70' and has an endless belt similar to the drive belt 2*d* that has a circular cross section. The driving of the drive shaft 70' is accomplished by a gear connection between it and the drive shaft 70.

As mentioned above, each of the units are in sub-frames, which are formed by the plates, such as 200, an end support 16*e* and a vertical box member, such as 167, as well as the plate 300 and the cross members 201. Each of these sub-frames is mounted for lateral movement by rollers 180 and 181, which ride on a rail 168 of the main frame (see FIGS. 1 and 2) and by rollers 184, which ride on a rail 186. Each of the sub-frames is threadably received on a spindle 188 so that rotation of the spindle will cause both frames to shift either away from each other or toward each other, depending on the direction of rotation of the spindle. Thus, the position of the rollers on each side can be adjusted for engaging blanks or workpieces of different widths.

As indicated above, the lateral aligning device includes a first assembly or sub-frame consisting of three pairs P1–P3 of rollers 1 and 2, which is situated on the operator's side of the device or machine, and a second sub-frame situated on the opposite side of the operator, which also has three pairs of upper and lower rollers. This arrangement has been revealed to be appropriate for achieving the alignment of the sheet or workpiece F along a ruler 100 situated on one or the other sides, depending on the requirements. Obviously, if alignment is to be done according to the ruler 100 situated on the side opposite the operator, the upper rollers 2 of the pair P1 and P3 situated on the operator's side are continuously held in a rest position. It is, thus, also possible on a general basis to envision only one assembly of the pairs P1–P3 of the rollers 1 and 2 arranged only along one side over the whole maximum length of the operating size.

The front aligning device 1000, shown in FIG. 4, is situated immediately after the lateral aligning device M so that a sheet or workpiece F leaves the lateral aligning device and simultaneously enters into a passage 80 consisting of upper and lower guiding plates 81 and 82 belonging to a front lay device.

The front alignment is achieved by means of two movable front lays or stops 9, each of which are fitted on an endless toothed belt 90. The two movable lays are offset in a lateral or crosswise direction to engage two laterally offset points on a front edge of the workpiece.

The toothed belt 90 forms a closed loop with a return track on top and the forward moving track on the bottom and being parallel to the passage 80. The belt 90 is guided by four pulleys or rollers 90*a*-90*d*, with the roller 90*a* being arranged adjacent the inlet, the roller 90*b* being positioned above the roller 90*a*, the roller 90*c* being adjacent the outlet of the device, and the roller 90*d* being disposed thereabove. The pulley 90*a* can be the driven pulley. It is obvious that both belts 90 are driven at the same speed. A tightener means 900 acts on the pulley 90*b*.

A single front lay or stop 9 is forseen for each belt 90. The front stop is provided with supporting sides 9*a* which serve as an arresting piece for the front edge of every workpiece F when pushed forward with the speed V1' by the rollers 1 and 2 of the previous device for lateral alignment. The speed V1' exceeds a shifting speed V2' of the movable front stops 9 and, thus, the speed of the belt. In other words, the dimensions and speeds V1' and V2' of the assembly are to be such that with every alignment of the sheet F, the front stops 9 will move first with a speed V2' into the passage 80 to be followed by the sheet F and the front edge. The front edge of the sheet F will then be pushed against the rear side 9*a* of each of the front stops, since V1' is greater than V2'.

In order to insure that the sheet F is shifted with the speed V2' when the front stops 9 disengage from the sheet F at the time the belt passes over the lower discharge pulley 90*c*, this pulley 90*c* is coaxially associated with a drive roller 93, which has a peripheral speed equal to the speed V2' and which coacts with a pressing roller 94 situated underneath the sheet F. The sheet F is then driven out of the device for front alignment and toward, for example, a printing station, with reference to which it is determined the lengthwise position of the movable front stops 9 with regard to the rollers 93 and 94. The pressing roller 94 is mounted on a balancing beam allowing an adjustment in the proper distance between the two rollers 93 and 94, as required by changes in the thickness of the workpieces being processed.

Although various minor modifications may be suggested by those versed in the art, it should be understood that I wish to embody within the scope of the patent granted hereon all such modifications as reasonably and properly come within the scope of my contribution to the art.

I claim:

1. A device for aligning a plate or sheet-shaped workpiece for an infeed station of a workpiece processing machine for forming packages, said device comprises a feeding table provided with a horizontal passage allowing the workpiece to travel through one-by-one, said passage having a length in the travelling direction at least equal to the maximum length of a workpiece to be processed, at least two pairs of rollers being provided adjacent one edge of the feeding table with each pair of rollers including a lower roller and an upper roller arranged for the workpiece to pass therebetween, each lower roller of each pair being mounted for rotation around a substantially fixed axis extending perpendicular to the travelling direction of the workpiece through the device, means for mounting each of the upper rollers to allow shifting of the upper roller between an upper rest position and a lower engaging position and pivoting of the upper roller between a first position with the axis being substantially parallel to the axis of the lower roller and a second position with the axis forming an angle in a range of 5° to 10° relative to the axis of the lower roller, means driving each of the upper rollers with a peripheral speed identical to the peripheral speed for the lower roller, said means for mounting each of the upper rollers including elastic means for urging each of the upper rollers to the second position with the axis extending at an angle to the angle of the lower roller against the resistance of the travelling sheet, and control means for shifting the upper roller between the upper rest and the lower engaging position, said control means holding the upper roller in the upper rest position as a front leading edge of a workpiece approaches the pair of rollers and shifting the upper roller to the lower engaging position as soon as the leading edge of the workpiece is disposed between the rollers to grasp said workpiece.

2. A device according to claim 1, wherein at least four pairs of rollers are provided with the roller pairs being divided into two assemblies, with one assembly along an operator's side, and the other being disposed along a side opposite to said operator's side, means mounting all lower rollers in each assembly including a bar mounted for pivotable movement along a horizontal axis so that all the lower rollers can be shifted from a position for conveying a workpiece to a second position dropping a defective workpiece from the feed table.

3. A device according to claim 2, wherein each of the assembly of pairs is mounted in a separate sub-frame and each sub-frame is shiftable relative to the other sub-frame to allow adjustment for changes of width in the workpiece being processed.

4. A device according to claim 1, which includes stop means for aligning a front leading edge of each workpiece, said stop means being positioned at a discharge side of said device for receiving a workpiece being discharged from the outlet thereof, said stop means including means forming a horizontal passage as an extension of the passage existing between the lower and upper rollers of the feeder table, at least one movable front stop carried on a continuous belt in a closed loop with a portion of the path being parallel to the horizontal passage, means moving said belt with a speed slower than the speed of a discharge of the workpiece from said device so that the front leading edge of the workpiece will be forced against said stop.

5. A device according to claim 4, wherein the stop means includes two movable front stops, each fitted on a separate belt, extending in a closed loop, each having a portion extending parallel to the passage, each belt including a downstream pulley adjacent the outlet of said stop means coaxially mounted with a driving roller having a peripheral speed equal to the speed of movement of the front stop, said driving roller acting with a pressure roller disposed below the path to remove the workpiece out of a discharge end of the stop means.

6. A device according to claim 1, wherein the means for mounting each of the upper rollers includes a first support having a pair of flanges forming a strap for supporting the upper roller of each pair, a second pair of flanges extending opposite to the first pair, an intermediate support extending into said second pair of flanges of the first support with the first support being pivotably mounted on said intermediate support, said intermediate support being connected to a cylindrical support mounted on a frame of the device for rotation around a horizontal axis, actuating means being disposed in said cylindrical support having an output shaft engaging an axle supported on the second pair of flanges, said actuating means biasing the upper roller to said second position, said cylindrical support being provided with two radial arms angularly spaced, each arm having a roller with one roller being acted on by a second pneumatic jack to rotate said cylindrical support to rotate said upper roller between the rest position and the engaging position.

* * * * *